US009656506B1

(12) United States Patent
Reddy

(10) Patent No.: US 9,656,506 B1
(45) Date of Patent: May 23, 2017

(54) PRECIOUS METAL COMPOSITE USEFUL AS A MEDIUM OF EXCHANGE

(71) Applicant: Walter Reddy, Weston, CT (US)

(72) Inventor: Walter Reddy, Weston, CT (US)

(73) Assignee: Pure Grains of Gold, LLC, Cheyenne, WY (US)

( * ) Notice: Subject to any disclaimer, the term of this patent is extended or adjusted under 35 U.S.C. 154(b) by 195 days.

(21) Appl. No.: 14/303,115

(22) Filed: Jun. 12, 2014

Related U.S. Application Data

(60) Provisional application No. 61/837,208, filed on Jun. 20, 2013.

(51) Int. Cl.

| | |
|---|---|
| ***B42D 1/08*** | (2006.01) |
| ***B42D 5/00*** | (2006.01) |
| ***B42D 5/02*** | (2006.01) |
| ***B42F 1/00*** | (2006.01) |

(52) U.S. Cl.
CPC ..... *B42F 1/00* (2013.01); *B42D 1/08* (2013.01); *B42D 5/00* (2013.01); *B42D 5/003* (2013.01); *B42D 5/02* (2013.01); *B42D 5/021* (2013.01)

(58) Field of Classification Search
CPC . B42D 5/00; B42D 5/02; B42D 5/003; B42D 1/08
USPC ..... 281/38, 22; 283/57–59
See application file for complete search history.

(56) References Cited

U.S. PATENT DOCUMENTS

| | | | | |
|---|---|---|---|---|
| 1,350,733 | A * | 8/1920 | Olson | B42D 5/001 281/38 |
| 1,655,483 | A | 1/1928 | Wheeler | |
| 2,769,265 | A | 11/1956 | Page | |
| 3,089,800 | A | 5/1963 | Colfer et al. | |
| 3,950,015 | A | 4/1976 | Shrock | |
| 4,698,021 | A | 10/1987 | Shoher et al. | |
| D315,745 | S | 3/1991 | Noyman | |
| 5,120,589 | A | 6/1992 | Morikawa et al. | |
| 5,445,418 | A | 8/1995 | Blend | |
| D480,419 | S | 10/2003 | Anderson | |
| D615,599 | S | 5/2010 | Hashim | |

(Continued)

FOREIGN PATENT DOCUMENTS

| | | |
|---|---|---|
| AU | 2010229329 | 10/2011 |
| WO | 2010110883 | 3/2010 |

OTHER PUBLICATIONS

GoldandSilverBullionSales.com, "World First Equity Trade Note," download at: http://www.goldandsilverbullionsales.com/gold-silver-products/equity-trade-note/ , 2010.

(Continued)

*Primary Examiner* — Kyle Grabowski

(74) *Attorney, Agent, or Firm* — Wiggin and Dana LLP; Gregory S. Rosenblatt; Andrew D. Bochner

(57) ABSTRACT

A medium of exchange that is not separated from the backing item of value, has variable value and authentication protections sufficient to retain the trust of consumers is formed as a laminate having a backing layer and a precious metal foil layer. The precious metal foil layer has a predetermined weight and the laminate is dividable into multiple portions each one of which is a determinable fraction of the predetermined weight. An authentication seal is formed in an obverse side of the instrument and each one of the multiple portions contains indicia on a rear side thereof identifying the determinable fraction.

16 Claims, 5 Drawing Sheets

(56) References Cited

U.S. PATENT DOCUMENTS

| | | | | |
|---|---|---|---|---|
| 8,189,862 | B2 | 5/2012 | Zhao et al. | |
| 8,301,893 | B2 | 10/2012 | Brundage | |
| 2005/0072520 | A1 | 4/2005 | Berman | |
| 2011/0039042 | A1 * | 2/2011 | Johansen | B32B 27/06 428/29 |

OTHER PUBLICATIONS

Sculpt Nouveau, "Ever-Clear," download at: http://www.sculptnouveau.com/Details.cfm?ProdID=98&category=7 , 2013.

Board of Governors of the Federal Reserve System, "Is U.S. Currency Still Backed by Gold?", download at: http://www.federalreserve.gov/faqs/currency_12770.htm , 2013.

* cited by examiner

PRECIOUS METAL COMPOSITE USEFUL AS A MEDIUM OF EXCHANGE

CROSS REFERENCE TO RELATED APPLICATIONS

This patent application claims a benefit to the filing date of U.S. Provisional Patent Application Ser. No. 61/837,208, titled "Precious Metal Composite Useful as a Negotiable Instrument," by Reddy that was filed on Jun. 20, 2014. The disclosure of U.S. 61/837,208 is incorporated by reference herein in its entirety. This patent application is related to U.S. Design patent application Ser. No. 29/458,492, titled "Negotiable Instrument" by Reddy that was filed on Jun. 20, 2013.

U.S. GOVERNMENT RIGHTS

N.A.

BACKGROUND

Field

This invention relates to a medium of exchange. More particularly, to a medium of exchange that is not separated from an item of value associated with that instrument and is further not fixed in value.

Description of the Related Art

Mediums of exchange, such as bonds and currency, are backed by something of value, be it a company, or government, promise to pay or something of value, such as precious metal. Until Jan. 30, 1934, United States Federal Reserve notes were redeemable for gold or silver. As of that date, they were no longer redeemable for gold and the notes have not been redeemable in silver since the 1960's. However, as the medium of exchange is separate from the item of value backing the instrument, the value is tied to the confidence the market has in the issuer.

A medium of exchange that is not separated from the item of value is Equity Trade Note that contains one tenth of a troy ounce of 99.9% pure gold laminated between security paper and a polymer. At a gold price of $1,500 per troy ounce, the "Equity Trade Note" has a value of about $150.

While the Equity Trade Note carries its value with the medium of exchange, it has a fairly high value and does not provide for denominations other than the one fixed by the initial selection of gold content. It is to be expected that many transactions will require a value amount other than that fixed in the note. There remains a need for a medium of exchange that is not separated from the backing item of value that has variable value and authentication mechanisms sufficient to retain the trust of consumers.

BRIEF SUMMARY OF THE DISCLOSURE

Disclosed herein is a medium of exchange that is not separated from the backing item of value, has variable value and authentication protections sufficient to retain the trust of consumers is formed as a laminate having a backing layer and a precious metal foil layer. The precious metal foil layer has a predetermined weight and purity and the laminate is dividable into multiple portions each one of which is a determinable fraction of the predetermined weight. An authentication seal is formed in an obverse side of the instrument and each one of the multiple portions contains indicia on a rear side thereof identifying the determinable fraction A feature of one embodiment of the disclosure is that each medium of exchange contains one grain of a high purity, such as 99.99% by weight, of gold or silver. The mediums of exchange may then be provided in booklets of 48 having 1/10 troy ounce of the precious metal.

BRIEF DESCRIPTION OF THE DRAWINGS

Like reference numbers and designations in the various drawings indicated like elements.

DETAILED DESCRIPTION

Figure 1:
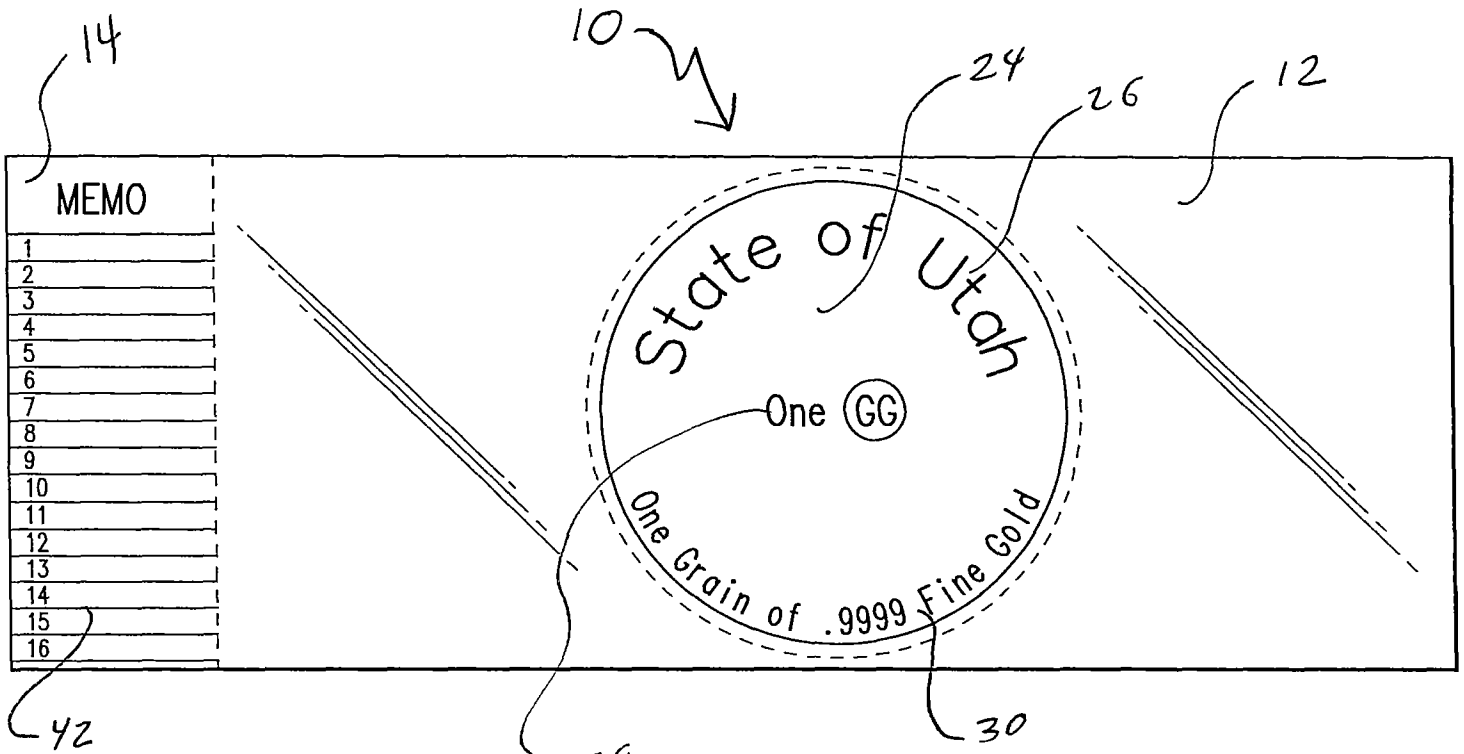
FIG. 1 is a plan view of the obverse side of a medium of exchange as disclosed herein.
Figure 4:
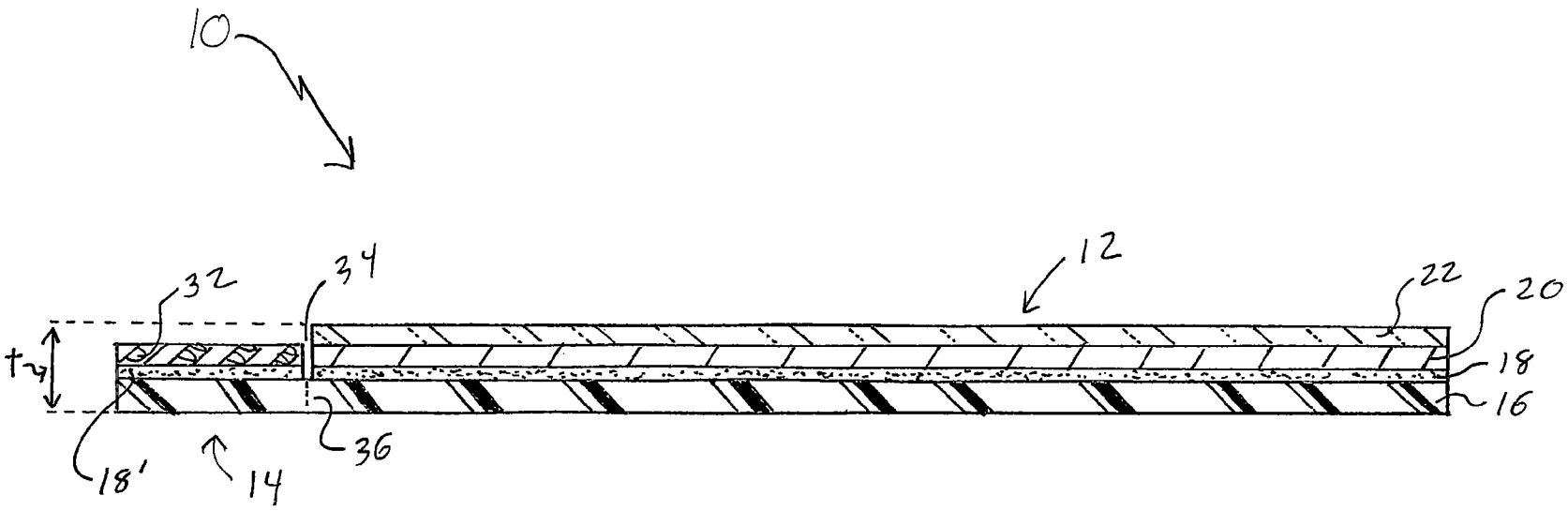
FIG. 4 is an expanded cross-sectional view of the medium of exchange of FIG. 1.

FIG. 1 is a plan view of the obverse side of a medium of exchange 10. The medium of exchange has a precious metal portion 12 and a memo portion 14. FIG. 4 shows the medium of exchange 10 in expanded cross-section. If the precious metal portion has exemplary dimensions of 2.5 inches by 6 inches, then the total thickness, t, is between 0.0005 inch and 0.0008 inch (0.5-0.8 mils) and preferably about 0.6 mils.

The precious metal portion 12 is a laminar structure that includes a backing layer 16 formed from a flexible, tear-resistant, chemical resistant material, such as a polyester film, for example a stretched polyethylene terephthalate, Mylar® (trademark of DuPont, Wilmington, Del.). An adhesive layer 18 bonds the backing layer 16 to a precious metal foil layer 20. One suitable adhesive for adhesive layer 18 is Charbonnel Gold Size, available from Dick Blick Art Materials, Galesburg, Ill.

The precious metal foil layer 20 may be any metal having an accepted value per given weight. Typically, the precious metal will be a high purity gold or silver, such as 0.9999% by weight, where many financial indexes, such as the Wall Street Journal, provide a daily value per troy ounce. The thickness of the precious metal foil layer will vary based on the density of the metal and the length and width of the layer. However, the weight of the precious metal, and hence its value, will be accurately known. A common measurement of small amounts of precious metal is the grain. One grain is equal to 0.064799 grams and to 0.0020833 troy ounce. In one embodiment, the weight of the precious metal foil is one grain +/−0.01 grain. When the price of gold is set in the financial indexes as $1,500 per ounce, one grain of gold has an intrinsic value of $3.12.

As high purity gold and silver are both very soft, preferably, a transparent protective coating layer 22, such as a varnish, overlies the precious metal foil layer and may also overlie the backing layer 16 on the reverse side. One suitable varnish is Ever-Clear acrylic urethane, available from Sculpt Nouveau that is distributed by Industrial Metal Supply.

Referring back to FIG. 1, the precious metal portion includes an authentication seal 24 to indicate the jurisdiction 26, perhaps state or province, the certifies the weight and purity of precious metal present, the weight of precious metal 28, where GG could correspond to "Gold Grain" and "SG" could correspond to "Silver Grain" to set the unit of value in combination with a statement of purity 30. The authentication seal is formed by any method known in the art to resist tampering, such as embossing or formed as a hologram either under or in the transparent protective coating layer.

Adjacent the precious metal portion 12 is a memo portion 14. The obverse side of the memo portion is formed from a material that may readily receive writing such as from a pencil or pen. Referring back to FIG. 4, the backing layer 16 extends to the memo portion 14. Optionally, the adhesive layer 18 may also extend to the memo portion, or a different adhesive 18' may be applied over the backing layer. A writable layer 32 is then bonded to adhesive 18'. The writable layer 32 may be any material that readily receives pencil lead and pen ink, such as paper. As it may be desirable to separate the memo portion 14 from the precious metal portion, for example to retain the memo portion for records or the reclaim the precious metal of the precious metal portion, the interface 34 between the two portions may be weakened, such as with perforations 36.

Figure 2:
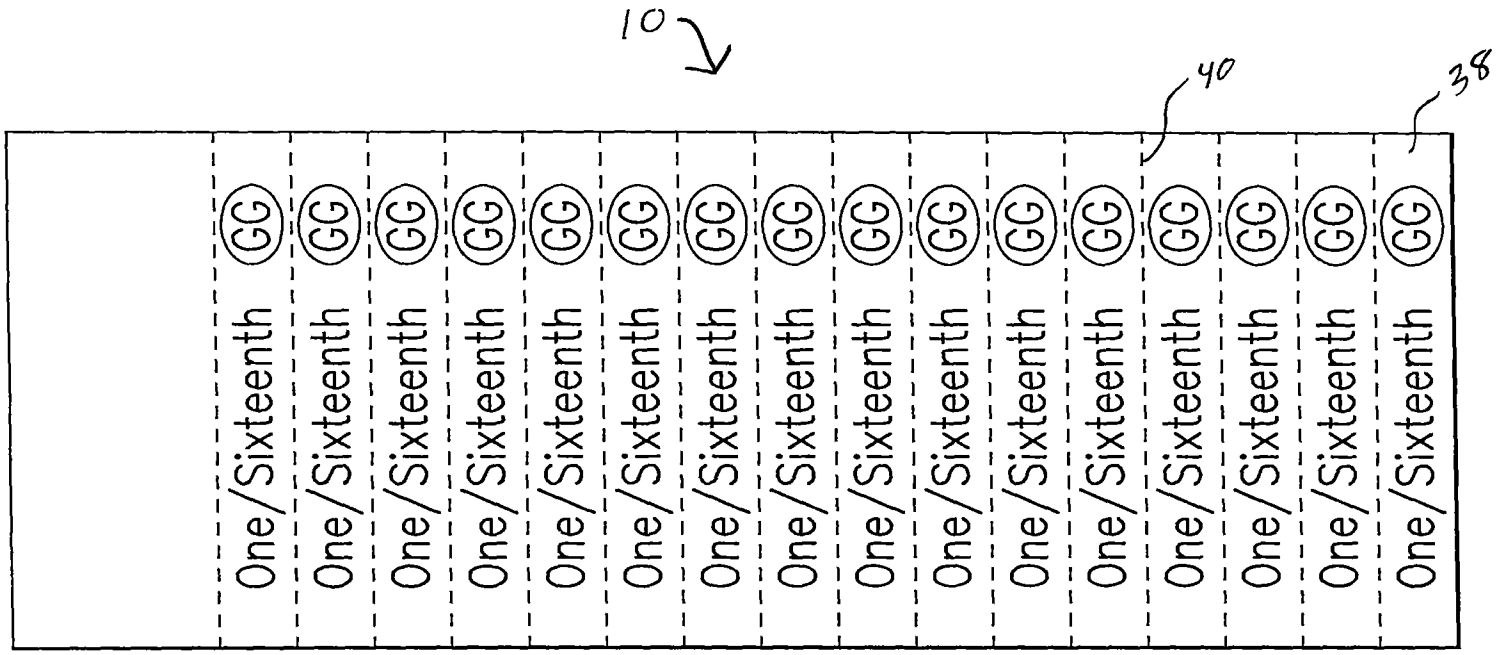
FIG. 2 is a plan view of a first embodiment of the reverse of the medium of exchange of FIG. 1.

Referring to FIG. 2, the value of the medium of exchange 10 may exceed the value of an item desired for purchase. The medium of exchange 10 is dividable into segments 38 that represent predefined portions of the medium of exchange, such as 1/10, 1/16, 1/8 or 1/4 grain. To make a payment of less than the full value of the medium of exchange 10, one or more segments 38 are separated from the medium of exchange. Perforations 40 may be provided to assist with the separation. Referring back to FIG. 1, the memo portion 14 may include data lines 42 for writing down the disposition of each segment.

Figure 3:
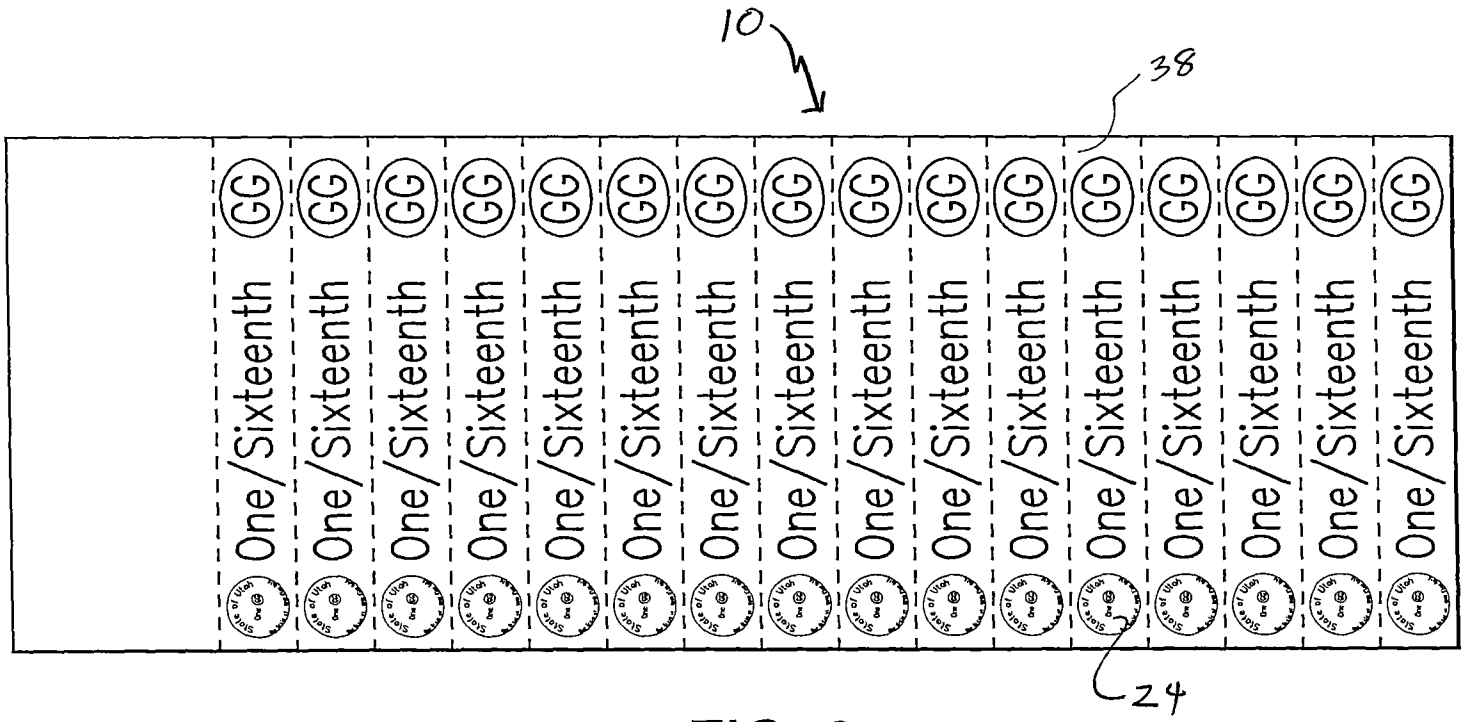
FIG. 3 is a plan view of a second embodiment of the reverse of the medium of exchange of FIG. 1.

Referring to FIG. 3, each segment 38 has a value. To enable further circulation of a segment removed from the medium of exchange 10, each segment may separately include an authentication seal 24 that may be the same as the authentication seal on the obverse side, but smaller weight or it may have a hologram authentication seal designating the weight.

Figure 5:
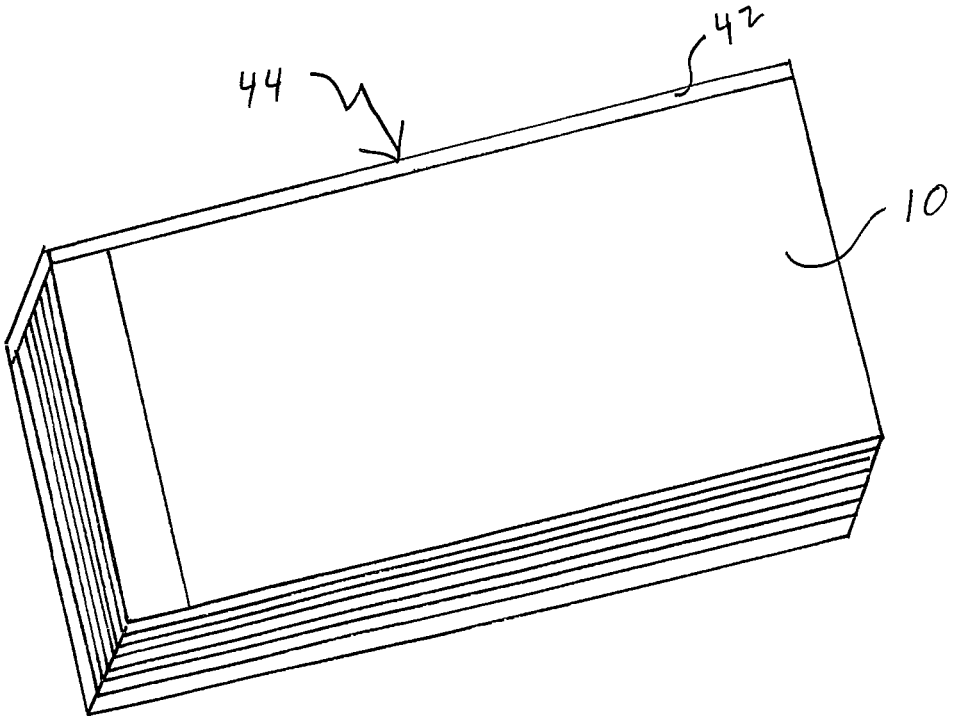
FIG. 5 is a perspective view of a booklet containing multiple mediums of exchange.

FIG. 5 illustrates that multiple mediums of exchange 10 may be supported by a binder 42 and removable therefrom, such as checks from a check book. In one embodiment, booklet 44 includes 48 medium of exchanges 10, each with one grain of precious metal, such that the booklet has 1/10 troy ounce of precious metal and a box of 10 booklets 44 would constitute one troy ounce of the precious metal.

One or more embodiments of the present invention have been described. Nevertheless, it will be understood that various modifications may be made without departing from the spirit and scope of the invention. For example, the laminates may be appealing to art collectors or numismatists. Accordingly, other embodiments are within the scope of the following claims.

What is claimed is:

1. A medium of exchange, comprising:

a laminate having a backing layer, a precious metal foil layer, and an adhesive layer, the adhesive layer disposed between the backing layer and the precious metal foil layer, the adhesive layer including an adhesive bonding the backing layer to the precious metal foil layer, the precious metal foil layer having a predetermined weight, wherein said laminate is dividable into multiple portions each one of said respective multiple portions being a determinable fraction of the predetermined weight;

wherein one of the length and the width of the backing layer is larger than a length and a width of the precious metal foil layer whereby the laminate is divided into a memo portion that is devoid of the precious metal foil layer and a precious metal portion including the precious metal foil layer; and wherein the backing layer is covered with a writeable layer, the writing layer bonded to the adhesive layer.

2. The medium of exchange of claim 1 wherein the memo portion is separateable from the precious metal portion.

3. The medium of exchange of claim 2 wherein an interface between the memo portion and the precious metal portion contains perforations to facilitate separation.

4. The medium of exchange of claim 1 wherein an authentication seal is formed in an obverse side thereof.

5. The medium of exchange of claim 4 wherein a protective coating is applied over said precious metal foil layer.

6. The medium of exchange of claim 5 wherein said authentication seal is embossed into said precious metal foil layer.

7. The medium of exchange of claim 5 wherein said authentication seal is disposed between said precious metal layer and said protective coating.

8. The medium of exchange of claim 4 wherein each one of said multiple portions contain indicia on a rear side thereof identifying said determinable fraction.

9. The medium of exchange of claim 8 wherein said indicia further includes said authentication seal.

10. The medium of exchange of claim 8 wherein said precious metal foil layer is one grain of gold.

11. The medium of exchange of claim 8 wherein said precious metal foil layer is one grain of silver.

12. A booklet containing a plurality of mediums of exchange, wherein each one of said mediums of exchange comprises:

a laminate having a backing layer, a precious metal foil layer with a protective coating overlying said precious metal foil layer, and an adhesive layer, the adhesive layer disposed between the backing layer and the precious metal foil layer, the adhesive layer including an adhesive bonding the backing layer to the precious metal foil layer;

the precious metal foil layer having a predetermined weight, wherein said laminate is dividable into multiple portions each one of said respective multiple portions being a determinable fraction of the predetermined weight;

one of the length and the width of the backing layer is larger than a length and a width of the precious metal foil layer whereby the laminate is divided into a memo portion that is devoid of the precious metal foil layer and a precious metal portion including the precious metal foil layer;

an authentication seal is formed in an obverse side thereof; and each one of said multiple portions containing indicia on a rear side thereof identifying said determinable fraction wherein one of the length and the width of the backing layer is larger than a length and a width of the precious metal foil layer whereby the laminate is divided into a memo portion that is devoid of the precious metal foil layer and a precious metal portion including the precious metal foil layer; and wherein the backing layer is covered with a writeable layer, the writing layer bonded to the adhesive layer.

13. The booklet of claim 12 wherein said precious metal foil layer is one grain of gold.

14. The booklet of claim 13 containing 48 mediums of exchange that is equivalent to 1/10 troy ounce of gold.

15. The booklet of claim 14 wherein said gold has a purity of 99.99%, by weight.

16. The booklets of claim 15 wherein ten of said booklets are contained in a box equaling one troy ounces of gold.

* * * * *